United States Patent [19]

Ando et al.

[11] Patent Number: 4,791,262

[45] Date of Patent: Dec. 13, 1988

[54] VOLTAGE TRANSFORMER TYPE ELECTRIC FLUID HEATER

[75] Inventors: Masao Ando, Yokohama; Takeshi Nanri; Mikio Sho, both of Chiba, all of Japan

[73] Assignee: Chisso Engineering Co Ltd, Tokyo, Japan

[21] Appl. No.: 70,550

[22] Filed: Jul. 7, 1987

[30] Foreign Application Priority Data

Jul. 7, 1986 [JP] Japan ..... 61-159150

[51] Int. Cl.[4] ..... H05B 6/40

[52] U.S. Cl. ..... 219/10.51; 219/10.491; 219/10.65; 219/10.79; 219/10.43

[58] Field of Search ..... 219/10.51, 10.49 R, 219/10.79, 10.65, 10.43, 10.75, 10.491

[56] References Cited

U.S. PATENT DOCUMENTS

| | | | |
|---|---|---|---|
| 1,458,634 | 6/1923 | Waage . | |
| 1,656,518 | 1/1928 | Hammers | 219/10.51 |
| 1,671,839 | 5/1928 | Owen . | |
| 2,181,274 | 11/1939 | Jackson et al. . | |
| 2,273,037 | 2/1942 | Hothersall | 219/10.51 X |
| 2,277,223 | 3/1942 | Goodridge | 219/10.79 X |
| 2,407,562 | 9/1946 | Lofgren | 219/10.51 |
| 3,515,837 | 6/1970 | Ando | 219/10.49 R |
| 3,846,609 | 11/1974 | Enk | 219/10.79 |
| 4,503,305 | 3/1985 | Virgin | 219/10.51 |
| 4,511,777 | 4/1985 | Gerard | 219/10.51 |
| 4,602,140 | 7/1986 | Sobolewski | 219/10.51 |

FOREIGN PATENT DOCUMENTS

| | | |
|---|---|---|
| 911767 | 7/1946 | France . |
| 216899 | 9/1941 | Switzerland . |

*Primary Examiner*—Philip H. Leung
*Attorney, Agent, or Firm*—Fred Philpitt

[57] ABSTRACT

An electric fluid heater includes the secondary coil of a transformer which secondary coil consists of a heating element having a multiple-turned flow path which however is single-turned electrically. When the primary coil of the transformer is supplied with electric power, the secondary coil heats fluid which flows in the flow path.

6 Claims, 7 Drawing Sheets

FIG. 1
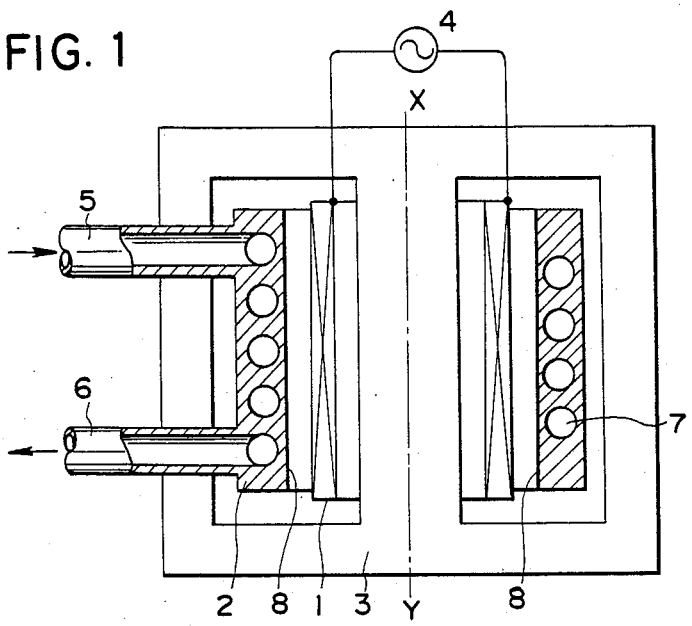
FIG.2A
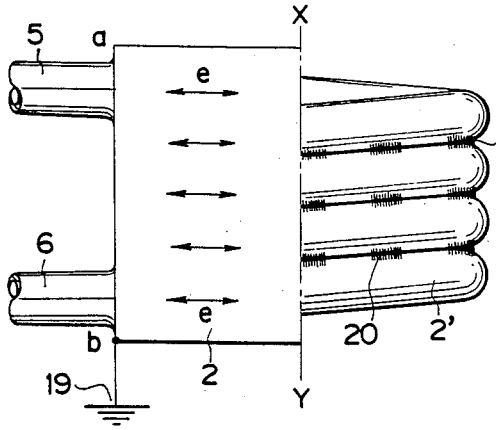
FIG.2B

VOLTAGE TRANSFORMER TYPE ELECTRIC FLUID HEATER

FIELD OF THE INVENTION

This invention relates to an electric fluid heater used to heat city water, liquid chemicals, gases or other fluid which, in particular, reaches a high temperature of several hundred degrees or a high pressure of several decade times the standard atmospheric pressure.

BACKGROUND OF THE INVENTION

Japanese Post-examination Publication No. 40-3353 of a utility model application discloses a water heater which is supplied with electric power from the primary of a transformer and uses the secondary coil as a tubular conductive heating element to heat water flowing therein. The heating water-inlet tube, i.e. the secondary coil, as well as the primary coil (wire coil) of the transformer is insulated throughout its entire length and entire surface area. That is, multiple turns of the secondary coil are insulated from each other to prevent short-circuit between respective turns thereof. Opposite ends of the water inlet tube, i.e. the entrance and exit of water, are electrically connected to prevent electrical leakage to the exterior of the water inlet tube.

This system certainly operates well when it heats water up to a modest temperature about 100° C. in the standard atmospheric pressure. However, if it is used as a large-scaled heater subject to a high temperature, high voltage and high pressure, various difficulties arise in its mechanical structure, and the efficiency of the transformer decreases. Further, this system fails to effectively use heat of the primary coil.

OBJECT OF THE INVENTION

It is therefore an object of the invention to overcome the problem involved in the prior art system and to provide a system reliably, effectively operative in high-temperature, high-pressure fluid heating and preferably using heat produced in the primary coil effectively.

SUMMARY OF THE INVENTION

In order to overcome the prior art problem, the invention provides an electric fluid heater in which the secondary coil conductor used as a heating element, although single-turned electrically, is double- or multiple-turned as a fluid flow path, so as to meet with the cross-sectional area and the length of the flow path determined by the allowable temperature difference between the fluid and the surface of the heating element, the allowed pressure loss of the fluid, or other factor. Further, if it is desired, the primary coil is partly or entirely made in the form of a metal tube which has an entrance for inletting fluid to be heated, and means for compressing the fluid from the metal tube, if necessary, and subsequently feeding it to the secondary coil heating tube.

This arrangement permits omission of insulation among multiple turns of the secondary coil, an increase of the window occupation ratio (the rate of the cross-sectional area occupied by the primary and secondary coil conductors in the window area of the transformer core), material saving and an increase in the system efficiency. Further, the invention arrangement makes it possible to average unbalances in the temperature of the secondary coil conductor used as a heating element to decrease the heat transfer area of the heating element, i.e. to decrease the required material of the system.

In a preferred embodiment of the invention, the primary coil is entirely or partly configured as a metal tube which has an entrance for inletting fluid to be heated, and means for compressing the fluid from the metal tube, if necessary, and subsequently feeding it to the secondary coil heating tube.

In the preferred embodiment, if the temperature of the fluid at the entrance of the heater is lower than the maximum heat-resistant temperature of the insulator of the primary coil, the fluid is used as a coolant of the primary coil.

More specifically, the primary coil is configured as a tube made from copper or other high-conductive material as it is normally made from copper, aluminum, silver or other high-conductive material, and the fluid to be heated is used in the tube as a coolant of the primary coil.

The fluid is heated at the exit of the primary coil up to a modest degree which is about 10% of the total heating power, for example, and is subsequently fed to the true heater, secondary coil, via a pressure pump provided at the position, if necessary.

Electrical insulation is normally required between the primary coil and the pump. However, it may be omitted if a point between the primary coil and the pump or the pump itself can be connected to ground. The secondary coil, although multiple-turned as the flow path is single-turned electrically. Therefore, insulation is not required normally between the pump and the secondary coil. Particularly, when the skin effect of the secondary coil is large, and the current is concentrated to the external superficial portion of the innermost circumferential wall of the secondary coil, insulation between the pump and the secondary coil is not required also in absence of ground connection of the interpoint or of the pump.

BRIEF DESCRIPTION OF THE DRAWINGS

FIG. 1 is a schematic transversal cross-sectional view for explanation of an electric fluid heater embodying the invention;

FIGS. 2A and 2B are two front elevations of a secondary coil conductor of the invention heater;

DETAILED DESCRIPTION

Figure 3B:
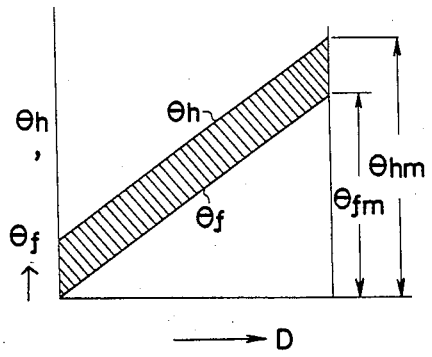
FIGS. 3A and 3B are views showing relationships between the heating element temperature and the fluid temperature in the invention system at 3A and in the known utility model at 3B.

The invention is described below in comparison with the prior art technology, referring to the drawings. However, the invention must never be construed as being limited to the illustrated embodiments.

Figure 13:
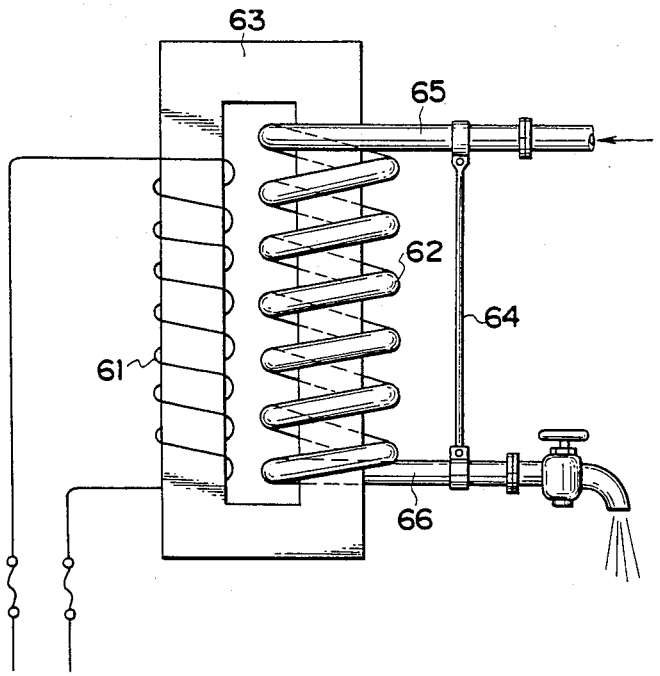
FIG. 13 PRIOR ART
FIG. 13 is a front elevation of a water heater according to Japanese Post-examination Publication No. 40-33533 of a utility model application.

FIG. 13 is a plan view of a hot water system disclosed by Japanese Post-examination Publication No. 40-33533 of a utility model application. In this drawing, reference numeral 61 refers to a primary coil, 62 to a secondary coil (water inlet tube), 63 to a core, 65 to an entrance tube for inletting water to be heated to the secondary coil 62, 66 to an exit tube of hot water from the secondary coil, and 64 to an electrical connection between tubes 65 and 66. The inlet tube 62 is made from aluminum, and its inner and outer surfaces are coated by aluminum oxide. An arrow shows the flowing dieection of the fluid to be heated.

FIG. 1 is a schematic cross-sectional view for explaining an embodiment of the invention, taking a single-phase core type as an example. In the drawing, reference numeral 1 denotes a primary coil, and 2 designates a secondary coil which serves as a heating element. A core 3 is common to the coils 1 and 2, and the system is supplied with power from a power source 4. Reference mark XY denotes a core axis.

Fluid to be heated, entering through a metal tube 5, is heated by a flow path 7 having continuous double or more turns while it flows therein, and exits from a metal tube 6. The illustrated flow path 7 is four-turned about the core 3. The positional relationship between the entrance and exit tubes 5 and 6 may be opposite to the illustration.

FIG. 2A schematically shows the secondary coil conductor portion. An electric field e produced in the secondary coil conductor 2 as shown by arrows in the drawing is vertical to the core axis XY having the primary coil wound thereon.

Therefore, any different points on the secondary coil conductor on any line parallel to the core axis XY are identical in electric potential, so that if the fluid entrance tube 5 and the fluid exit tube 6 are disposed on or near the line, no electrical arc is produced on possible metallic contact between the tubes 5 and 6. Therefore, the system safety is complete, no ground current is produced also when both tubes are connected to ground, and no electric shock occurs. 19 is a ground connection.

It should be noted here that the insulation between the electrical connection 64 and the coil in the aforegoing publication shown in FIG. 13 is not necessary because the secondary coil conductor (heating element) is single-turned. However, the primary coil has an electrical, thermal insulation corresponding to the temperature of the heater, and electrical thermal insulation on the surface of the secondary coil against the core 3 is required. However, since the invention system merely requires electrical insulation for a low voltage corresponding to a single turn as compared to the prior art utility mode, the occupation ratio of the transformer core window can be increased.

FIG. 2B shows an arrangement different from that of FIG. 2A in which welding 20 is provided throughout the entire length or at some points of an secondary tube coil 2' so that multiple turns (four turns in the illustration) of the fluid passing secondary tube coil 2' are electrically united into a single turn. In lieu of the welding, the secondary tube coil 2' may be casted into a single body with conductive material in a fashion similar to FIG. 1.

Also in FIG. 2B, the electric field e produced in the secondary tube coil 2' is substantially vertical to the core axis XY, which means that any different points on a line parallel to the core axis XY are identical in electric potential. Therefore, if the fluid entrance metal tube 5 and the fluid exit tube 6 are provided on or near the line, the same result as that of FIG. 2A is obtained upon metallic contact between the tubes 5 and 6.

The aforegoing explanation related to FIGS. 2A and 2B is based on an assumption that the skin effect of an alternating current within the secondary coil conductor may be disregarded, and on a specific arrangement in which the metal tubes 5 and 6 are disposed on identical potential points a and b on the secondary coil conductor.

In case that the skin effect is significantly large in the secondary coil conductor 2 or in the secondary tube coil 2', and if the primary coil 1 and the secondary coil conductor 2 are concentrical as in FIG. 1, the secondary alternating current represents a concentrated flow to the vicinity 8 of the secondary coil surface opposed to the primary coil, provided that the following relationship is established between the thickness t (cm) of the flow path wall in the radial direction of the secondary coil and the skin depth S (cm) of the alternating current:

$$t > 2S \tag{1}$$

Therefore, the electric field e shown in FIG. 2 is never produced in location other than the vicinity of the secondary coil surface opposed to the primary coil, and electrical arc upon metallic contact between the tubes 5 and 6 and electric shock against human beings or animals can be prevented by positioning the metal tubes 5 and 6 in the location having no electric field.

Additionally, a limited portion of the secondary coil conductor, i.e. the portion opposed to the primary coil, may be made from ferromagnetic material different from the material of the remainder portion of the secondary coil conductor so that the alternating current flowing in the secondary coil conductor concentrates to the limited portion opposed to the primary coil.

The skin depth S (cm) in expression (1), as well known, can be expressed by:

$$S = 5030\sqrt{\frac{\rho}{\mu f}}\ \text{(cm)} \tag{2}$$

where $\rho$ (ohm.cm) is the resistivity of the secondary coil conductor, $\mu$ is the specific permeability, and f (Hz) is the power source frequency.

The above-described skin effect increases with l/d where l (cm) is the height of the secondary coil conductor 2, and d (cm) is its inner radius.

The substantially same result is obtained by an oval or rectangular turn of the secondary coil other than an accurate cylindrical turn.

The skin depth S will be about 1 mm with a steel conductor and about 1 cm with a copper conductor at a commercial frequency (50 to 60 Hz). Therefore, when the secondary coil conductor is made from steel, the skin effect may be regarded to be large. If the secondary coil conductor is made from copper or non-magnetic steel, locations of the tubes 5 and 6 are preferably selected as shown above, disregarding the skin effect of the secondary coil conductor.

In case that the entrance and exit tubes 5 and 6 of the secondary coil conductor are disposed on or near a line parallel to the core axis XY, or alternatively if the skin effect inside the secondary coil conductor is large, no insulation flange is required for the entrance tube nor for the exit tube of the secondary coil conductor. However, in case that the skin effect inside the secondary coil conductor can be disregarded and that the entrance and exit tubes are disposed at positions substantially isolated from a line parallel to the core axis XY, insulation flanges are sometimes required for the entrance and exit tubes.

Figure 3A:
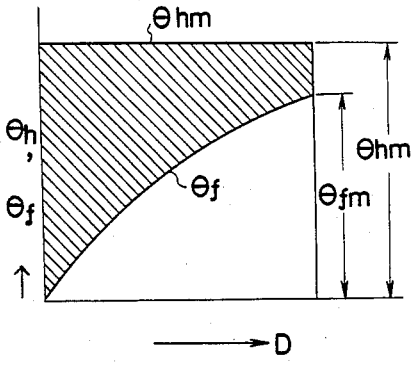

The electrical single turn of the secondary coil conductor unlike the prior art utility model system of FIG. 13 gives a further advantage that the temperature of the secondary coil conductor, i.e. the heating tube, can be uniformed in the length direction of the flow path 7. More specifically, the temperature of the fluid entering through the tube 5 in FIG. 1 gradually increases in the length direction of the flow path 7. The temperature tendency of the secondary coil heating element is low near the entrance tube 5 and high near the exit tube 6. However, since the single-turn secondary coil heating element is thermally unitary, the heat flows in and along the conductor from the tube 6 to the tube 5 and increases the temperature near the tube 5 while decreasing the temperature near the tube 6. This configuration is shown in FIG. 3A in which no large change occurs in the temperature $\theta h$ of the secondary coil conductor in the flowing direction D, but the temperature $\theta f$ of the fluid gradually increases.

In the prior art utility model of FIG. 13, the secondary tube coil 62 must be electrically insulated throughout its entire surface. Since such an electrical insulator is a thermal insulator, too, no great thermal transmission is expected in the secondary tube coil wall in the direction opposite to the fluid flow direction. That is, the temperature $\theta h$ of the heating element, i.e. the secondary tube coil 62, linearly increases, maintaining a substantially constant temperature difference with respect to the fluid temperature $\theta f$ as shown in FIG. 3B. These fluid temperature $\theta f$ and the heating element temperature $\theta h$ reach their maximum degrees at the fluid exit. Since the fluid temperature $\theta f$ and the heating element temperature $\theta h$ has their allowable maximum temperatures $\theta fm$ and $\theta hm$, the secondary coil conductor 2 of FIG. 1 according to the invention is obviously superior for its less thermal transmitting surface if the thermal transmission coefficients between the heating element surface and the fluid are identical between them. This is described in detail in pages 75 through 84 of "Kogyo Dennetsu Sekkei (Industrial Electric Heating Design)" by Masao Andoh (Nikkan Kogyo Shinbunsha).

The reduction in the heat transfer area contributes to a reduction of material not only of the heating element portion but also of the entire heater system including the core.

Figure 4:
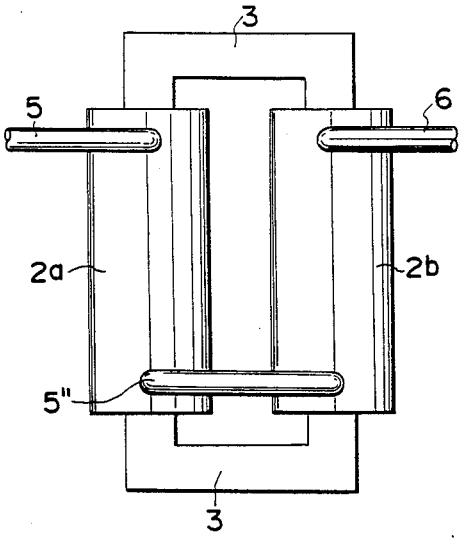
FIG. 4 is a front elevation of an electric fluid heater of single-phase core-type according to the invention.
Figure 5:
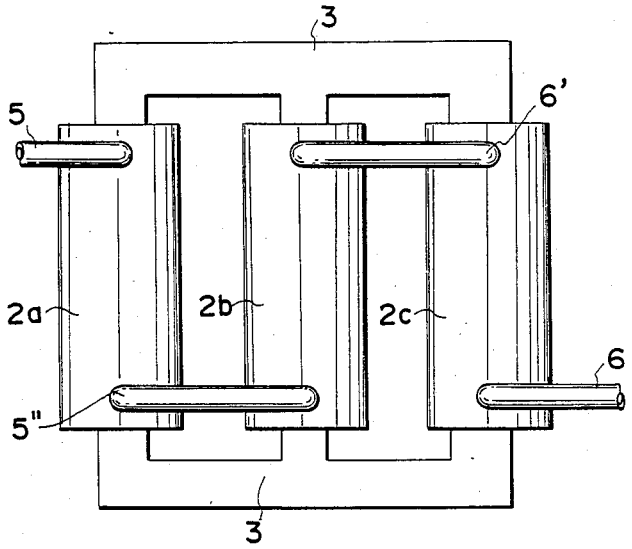
FIG. 5 is a front elevation of an electric fluid heater of thre-phase core-type according to the invention.

The aforegoing description exclusively refers to an invention transformer of single-phase shell-type. However, since no potential difference exists between the metal tubes 5 and 6, in either a core-type or three-phase transformer, it is established by connecting equivalents of the tubes 5 and 6 in series or in parallel in two core legs in case of core type and in three core legs in case of three-phase type. Their examples are shown in FIGS. 4 and 5. FIG. 4 is a front elevation of a single-phase core-type electric fluid heater, and FIG. 5 is a front elevation of a three-phase core-type electric fluid heater. In these drawings, reference numerals *2a, 2b* and *2c* denote secondary coil conductors including fluid flow paths, reference numerals 5 and 6 designate fluid entrance and exit, and numerals 5'' and 6' shown fluid conduits connecting the flow paths inside the secondary coil conductors. Inside the secondary coil conductors *2a, 2b* and *2c* exists the primary coil. Illustration of the power source and the wiring therefrom to the primary coil is omitted in FIGS. 4 and 5.

Figure 6:
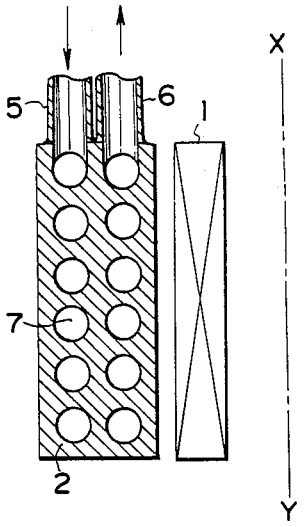
FIG. 6 is a schematic transversal cross-sectional view of the heater having a double-turned flow path 7.

FIGS. 1 and 2 shows the flow path 7 of single layer and four turns as an example. However, the flow path 7 may be of two or more layers and multiple turns as an example shown in FIG. 6 in which reference numerals 1, 2, XY, 5, 6 and 7 designate the same members or parts as those in FIG. 1. Obviously, two or more layers and multiple turns may be employed also in FIGS. 4 and 5.

As described above, the invention arrangement, as compared to the prior art system, simplifies its construction, decreases the required material, increases the heating efficiency and reliability, and establishes a high-temperature, high-pressure fluid heater which the prior art technology could not provide.

Further description follows about a further embodiment of the invention in which the primary coil is entirely or partly made in the form of a metal tube which includes an entrance for inletting fluid to be heated, and means for compressing the fluid from the metal tube when desired and subsequently feeding it to the secondary coil used as the heating element.

Figure 7:
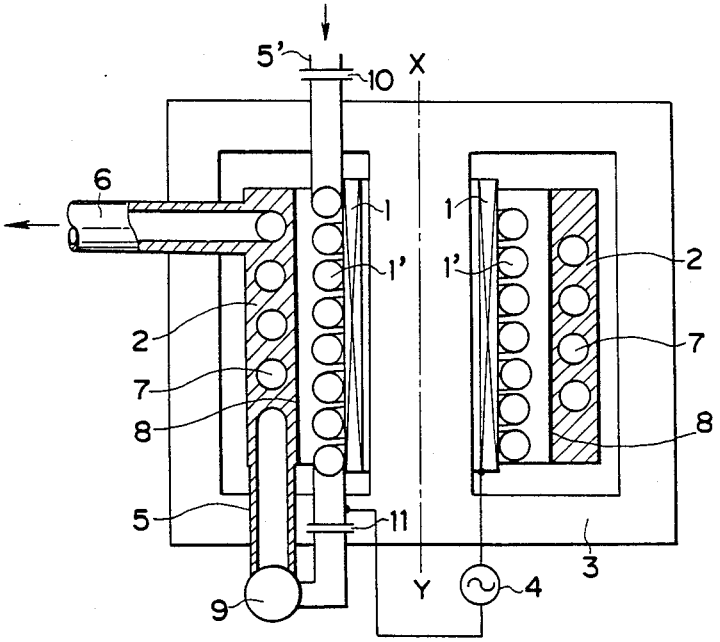
FIG. 7 is a schematic transversal cross-sectional view of a further embodiment of the invention system.

FIG. 7 is a schematic cross-sectional view for explanation of an arrangement of single-phase shell-type according to the embodiment. Reference numeral 1 designates a wire coil of the primary coil, 1' denotes a tube portion of the primary coil, 2 refers to the secondary coil conductor used as the heating element. The core 3 is common to the wire coil 1, tube portion 1' and secondary coil conductor 2, and the power source 4 supplies the primary coil 1 and 1' with electric power. Reference mark XY shows the core axis. Arrows show the flowing direction of fluid to be heated which also serves as a coolant.

The fluid to be heated enters through the inlet tube 5' to the primary coil and flows along the tube 1', cooling the primary coil 1 and 1' and thereby increasing its own temperature. The fluid is compressed by the pump 9, and flows in the flow path 7 of the secondary coil through the entrance tube 5. The fluid is heated while flowing along the flow path 7, and subsequently exits through the exit tube 6. Reference numerals 10 and 11 are insulation flanges. If the tube 5' is an insulative hose, the member at 10 need not be an insulation flange.

In FIG. 7, the secondary coil conductor 2 is a unitary cylindrical member throughout its entire length, and a spiral flow path is provided inside the cylinder wall. Although the secondary coil conductor 2 is single-turned electrically, the flow path is shown in multiple turns. In this case, the potential difference between the entrance tube 5 and the exit tube 6 is significantly small, and no insulation flange is required in these tubes in most cases.

Figure 8:
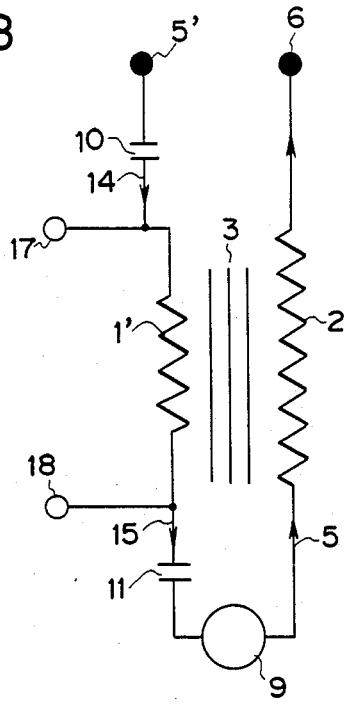
FIGS. 8 and 9 are schematic views of a circuit and a flow path in a still further embodiment of the invention system.

FIG. 8 is a schematic view of the circuit and flow path of an embodiment of the invention system. In this drawing, reference numeral 1' denotes a tubular primary coil which is entirely used as a flow path of fluid to be heated and used as a coolant. Reference numerals 2, 3, 5, 5', 6, 9, 10 and 11 show the same members or parts as those in FIG. 7. Arrows show the flowing direction of the fluid, 14 denotes the fluid entrance tube of the primary coil, 15 designates the fluid exit tube of the primary coil, and numerals 17 and 18 denote power source terminals. In this system, the primary coil is entirely tubular to allow the fluid to flow therethrough.

Figure 9:
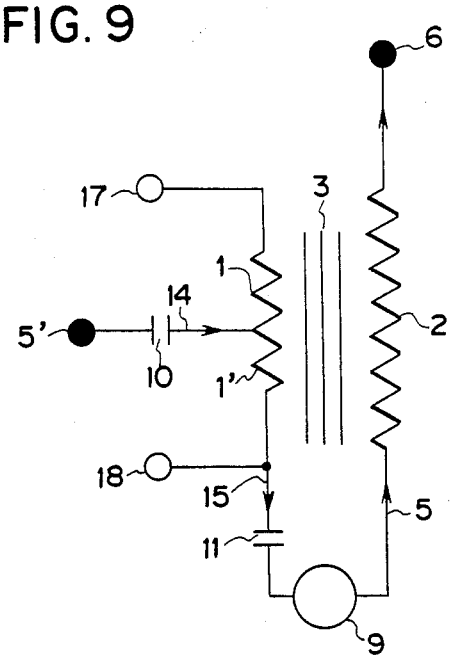

FIG. 9 is a schematic view of the circuit and flow path of a further embodiment of the invention system. In this drawing, reference numerals 1 and 1' denote the wire coil and the tube portion of the primary coil as in FIG. 7. The other reference numerals show the same members or parts as those in FIG. 8. Arrows show the flowing direction of the fluid. In the system of FIG. 9, a limited portion of the primary coil is configured as a tube of copper or other material. If the primary coil is multiple-layered as shown in FIG. 7, for example, a limited portion of its outermost layer opposed to the secondary coil is configured as a tube so that the fluid to be heated and used as a coolant flows therein. This arrangement is demanded to drop the allowable voltage of the insulation flanges 10 and 11 when the voltage between primary coil terminals 17 and 18 is high.

In FIGS. 8 and 9, when the primary coil shares 10% of the heating amount of the fluid, maintaining 0° C. for the fluid temperature at the entrance and maintaining 500° C. for same at the exit, the temperature at the exit tube 15 of the primary coil is 50° C. This modest temperature is acceptable, when using a normal construction of the pump 9.

Figure 11A:
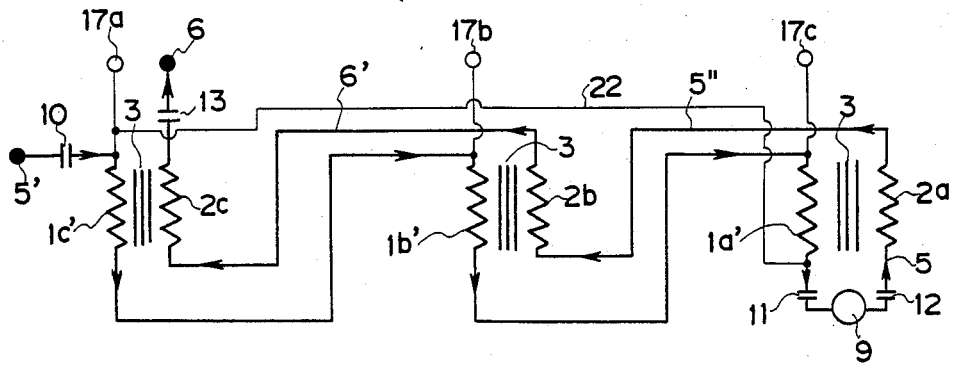
FIGS. 11A and 11B are schematic views of a circuit and a flow path in a yet further embodiment of the invention system of three-phase core type (delta-type).
Figure 12A:
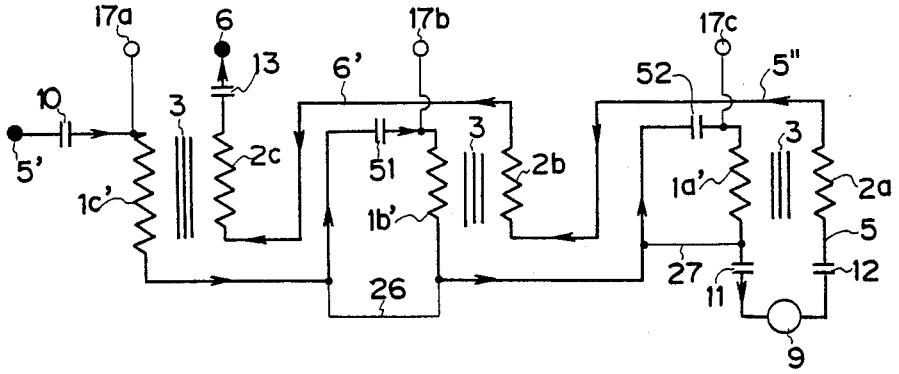
FIGS. 12A and 12B are schematic views of a circuit and a flow path in a yet further embodiment of the invention system of three-phase core-type (star-type)
Figure 11B:
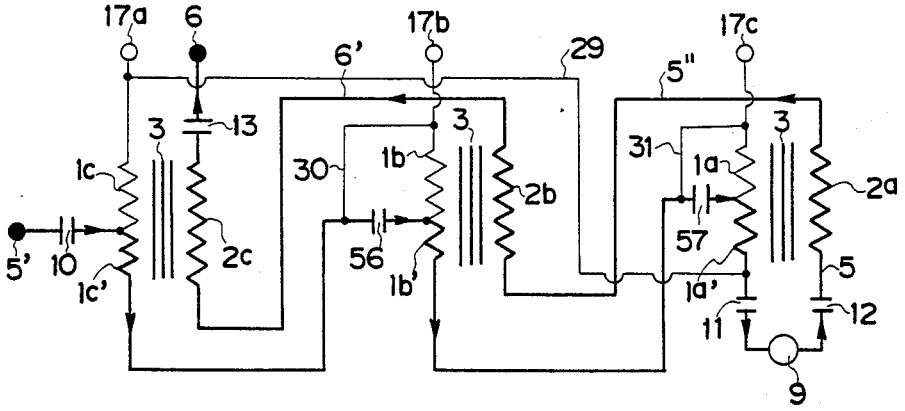
Figure 12B:
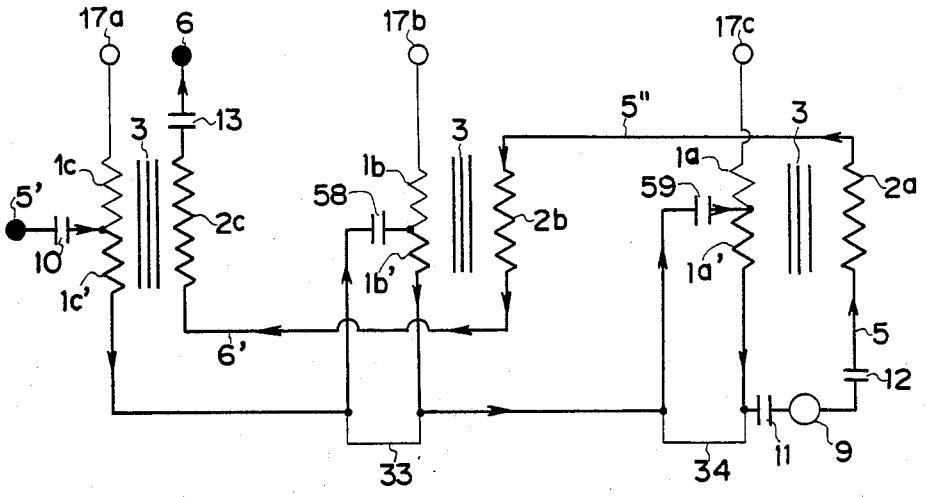

The aforegoing description refers to a single-phase shell-type heater. However, the invention may be used for single-phase core-type heating and three-phase type heating. Examples of single-phase core-type are shown in FIGS. 10A and 10B, examples of three-phase delta-type are shown in FIGS. 11A and 11B, and examples of three-phase star-type are shown in FIGS. 12A and 12B.

In these drawings, reference numerals 3, 5, 5', 5'', 6, 6', 9, 10, 11, 17 and 18 show the same members or parts as those in the aforegoing description. Reference numeral **1*a*, 1*b* and 1*c* show wire coils of the primary coil, and 1*a*', 1*b*' and 1*c*' denote tube portions of the primary coil. Reference numerals 2*a*, 2*b* and 2*c* refer to the secondary coil conductor used as the heating element, 12, 13, 51, 52, 55, 56, 57, 58 and 59 refer to insulation flanges, 22, 26, 27, 28, 29, 30, 31, 33 and 34** refer to electrical connections, and arrows show the flowing direction of the fluid to be neated and used as a coolant.

Figure 10A:
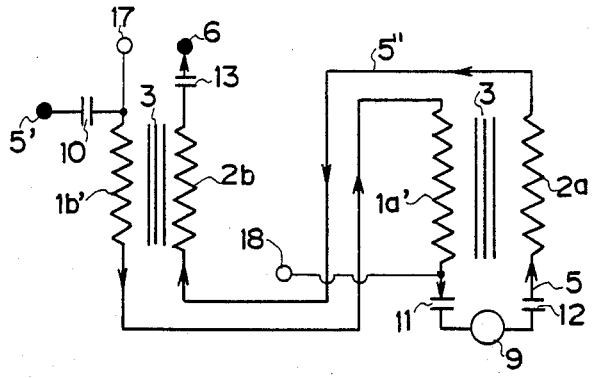
FIGS. 10A and 10B are schematic views of a circuit and a flow path in a yet further embodiment of the invention system of single-phase core type.

FIG. 10A is a schematic view of a circuit and a flow path in an arrangement of a single-phase core-type invention system. In this system, each half **1*a*' (1*b*') of the metal tube primary coil 1' of FIG. 8 is wound inside the secondary coil 2*a* (2*b*), and both halves 1*a*' and 1*b*' are connected in series to each other, electrically and phisically (in the sense of the flow path). Therefore, the system of FIG. 10A is identical to the system of FIG. 8** electrically and in the flow path arrangement.

Figure 10B:
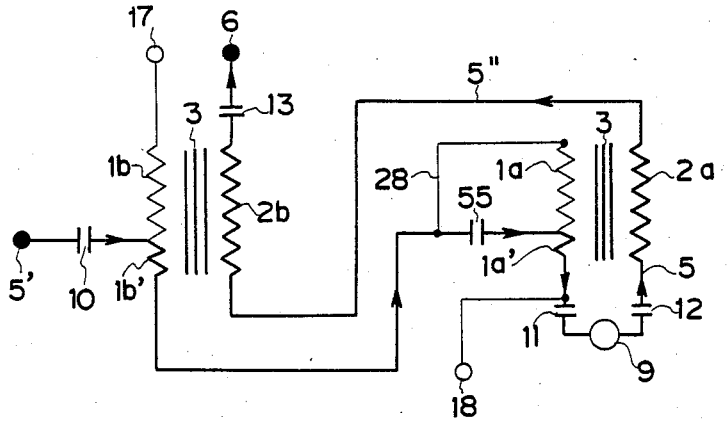

FIG. 10B is a schematic view of the circuit and a flow path in an arrangement of single-phase core-type in which the arrangement of FIG. 9 is used. In FIG. 10B, primary coil wire coils **1*a* and 1*b* and metal tube primary coils 1*a*' and 1*b*' series-connected to the wire coils 1*a* and 1*b* are all wound on the core 3, respectively. One end of the tube 1*b*' to be connected to the wire coil 1*b* is connected to the fluid inlet tube 5' whereas the other end of the tube 1*b*' is connected via the insulation flange 55 to one end of the tube 1*a*' to be connected to the wire coil 1*a*. The said other end of the tube 1*b*' or a conduit communicating therewith is connected by the electrical connection 28 at a position before the insulation flange 55 to one end of the primary coil wire portion 1*a* remote from the connection with the tube 1*a*'. The secondary coils 2*a* and 2*b* are wound outside the primary coils 1*a*, 1*a*', 1*b* and 1*b*'** respectively.

FIGS. 11A and 12A are schematic views each showing a circuit and a flow path of an embodiment of a three-phase core-type invention system in which the arrangement of FIG. 10A is applied. FIG. 11A shows a three-phase delta-type system, whereas FIG. 12A shows a three-phase star-type system.

FIGS. 11B and 12B are schematic views each showing a circuit and a flow path of an embodiment of a three-phase core-type invention system in which the arrangement of FIG. 10B is applied. FIG. 11B shows a three-phase delta-type system whereas FIG. 12B shows a three-phase star-type system.

In the systems of FIGS. 7, 8, 9, 10A, 10B, 11A, 11B, 12A and 12B, since the primary coil is cooled by the fluid to be heated, it does not invite much difficult problem in the insulation material nor in the mechanical construction. Beside this, the heater efficiency is improved because the primary coil loss in the original sense can be used effectively. Particularly, when diminishing the cross-sectional area of the current path of the primary coil, and elevating the current density by several times up to $10A/mm^2$ in case of copper tube, for example, it never invites any loss increase and rather decreases the dimension and weight of the primary coil. Further, when the secondary coil (heater) is wound on its outer circumference, its dimension and weight are decreased, and this leads to reduction in dimension and weight of the entire invention system.

What is claimed is:

1. An electric fluid heater comprising in combination (a) a primary coil which is supplied with electrical power, and (b) a secondary coil in the form of an elongated tube, (c) a transformer have a common core leg; passing through both said primary and secondary coils, (d) said secondary coil being single-turned electrically but multiple-turned as a fliud flow path, being made from a material whose skin effect with respect to an alternating current flowing therein is so small that it can be disregarded so as to thereby establish a substantially uniform current flow in said secondary coil, functioning as a heating element having a fluid entrance metal tube and a fluid exit metal tube, said entrance and exit metal tubes being disposed at positions identical in electric potential so as to prevent any electrical arc upon metallic contact between said entrance and exit tubes, (e) said primary coil being configured to heat fluid flowing in said secondary coil.

2. The electric fluid heater of claim 1 wherein said primary coil is at least partly configured as a metal tube which is provided with a fluid entrance for inletting fluid to be heated therethrough and means for optionally compressing the fluid from said metal tube and subsequently feeding it to said secondary coil.

3. An electric fluid heater comprising in combination
(a) a primary coil which is supplied with electrical power, and
(b) a secondary coil in the form of an elongated tube,
(c) a transformer having a common core leg passing through both said primary and secondary coils,
(d) said secondary coil
being single-turned electrically but multiple-turned as a fluid flow path,
being made from a material whose skin effect with respect to an alternationg current flowing therein is great so as to concentrate the alternating current to a limited portion of said secondary coil opposed to said primary coil,
said secondary coil having a fluid entrance metal tube and a fluid exit metal tube whereby any electrical arc is prevented between turns of said metal tube,
(e) said primary coil being configured to heat fluid flowing in said secondary coil.

4. The electric fluid heater of claim 3 wherein said primary coil is at least or partly configured as a metal tube which is provided with a fluid entrance for inletting fluid to be heated therethrough and means for optionally compressing the fluid from said metal tube and subsequently feeding it to said secondary coil.

5. An electric fluid heater comprising in combination
(a) a primary coil which is supplied with electrical power, and
(b) a secondary coil in the form of an elongated tube,
(c) a transformer having a common core leg, passing through both said primary and secondary coils,
(d) said secondary coil having a limited portion thereof which is opposed to said primary coil and that is made from a ferromagnetic material different from the material of the remainder of the secondary coil so as to concentrate an alternating current flowing in the secondary coil conductor to said limited portion.

6. The electric fluid heater of claim 5 wherein said primary coil is at least partly configured as a metal tube which is provided with a fluid entrance for inletting fluid to be heated therethrough and means for compressing the fluid from said metal tube and subsequently feeding it to said secondary coil.

* * * * *